US005148599A

United States Patent [19]

Purcell

[11] Patent Number: 5,148,599

[45] Date of Patent: * Sep. 22, 1992

[54] MOLD EXTRACTOR AND METHOD

[76] Inventor: Thomas L. Purcell, 8737 E. Hubbell St., Scottsdale, Ariz. 85257

[ * ] Notice: The portion of the term of this patent subsequent to Apr. 9, 2008 has been disclaimed.

[21] Appl. No.: 650,437

[22] Filed: Feb. 1, 1991

Related U.S. Application Data

[63] Continuation of Ser. No. 345,288, May 1, 1989, Pat. No. 5,005,286.

[51] Int. Cl.[5] ..... B26B 3/08

[52] U.S. Cl. ..... 30/1; 30/90.4; 30/168

[58] Field of Search ..... 7/151, 156; 30/168, 30/277, 1, 167, 90.4, 90.8; 81/3.09, 3.55

[56] References Cited

U.S. PATENT DOCUMENTS 5,005,286 4/1991 Purcell ..... 30/1

*Primary Examiner*—Joseph M. Gorski
*Attorney, Agent, or Firm*—Harry M. Weiss

[57] ABSTRACT

A mold extractor and method of manufacture thereof is provided. The extractor or tool is used to remove the annular wall, bottom wall, and lid of a plastic mold container from a concrete test sample taken at a construction site for later testing in a test laboratory. The extractor includes a hammer member, a guide member and a chisel member. The hammer is reciprocally displaced by an operator for applying a downward force on the container annular wall at the wall edge. The hammer has a peripheral wall having an elongate hole with an axis through which the guide portion extends. The hammer has enlarged end portions, for gripping by the operator and for applying the impact force. The guide member is an elongate round bar portion which has a handle at the top end thereof. The chisel member has a head portion, a square bar portion, a claw portion, and a chisel end portion. The claw portion is used for lifting the container lid by applying an upward force on the extractor. The chisel end portion has a pair of grooves forming a tee-shaped tip portion with knife-like edges. The chisel end portion is forced between the edge of the container annular wall separating the container inner surface from the concrete sample outer surface, while at the same time, cutting apart the plastic container annular side wall.

1 Claim, 1 Drawing Sheet

MOLD EXTRACTOR AND METHOD

This is a continuation of U.S. Ser. No. 345,288 filed May 1, 1989, now U.S. Pat. No. 5,005,286 entitled "MOLD EXTRACTOR AND METHOD" in the name of Thomas L. Purcell.

BACKGROUND OF THE INVENTION

1. Field of the Invention

The invention relates to a mold extractor and method, and in particular, the invention relates to a mold extractor and method having a hammer member, a hammer guide member and a chisel member.

2. Description of the Prior Art

The prior art mold extractor includes a conventional hammer and a conventional chisel.

One problem with the prior art extractor is that an operator is exposed to injury from a force from the hammer when holding the chisel against the mold. Injuries also occurred to the hand of the operator trying to exert force on the chisel to split the mold. Also, fragments from the chisel would strike a person's hand or body.

SUMMARY OF THE INVENTION

According to the present invention, a mold extractor is provided. This mold extractor includes a hammer member, a guide member, and an elongate chisel member for applying an impact force from the hammer member to the chisel member, wherein the chisel member has an axis and has a head portion coaxially connected to the guide member and has a chisel end portion coaxially connected to the head portion, said chisel end portion having tee-shaped tip portion with knife-like edges.

By using the chisel member coaxially connected to the guide member, an impact force from the hammer member to the chisel member is applied along the axis of the chisel member whereby injuries to the operator are minimized.

The foregoing and other objects, features and advantages will be apparent from the following description of the preferred embodiment of the invention as illustrated in the accompanying drawings.

DESCRIPTION OF THE PREFERRED EMBODIMENT

Figures 1, 2, 3, 4, 5, 6:
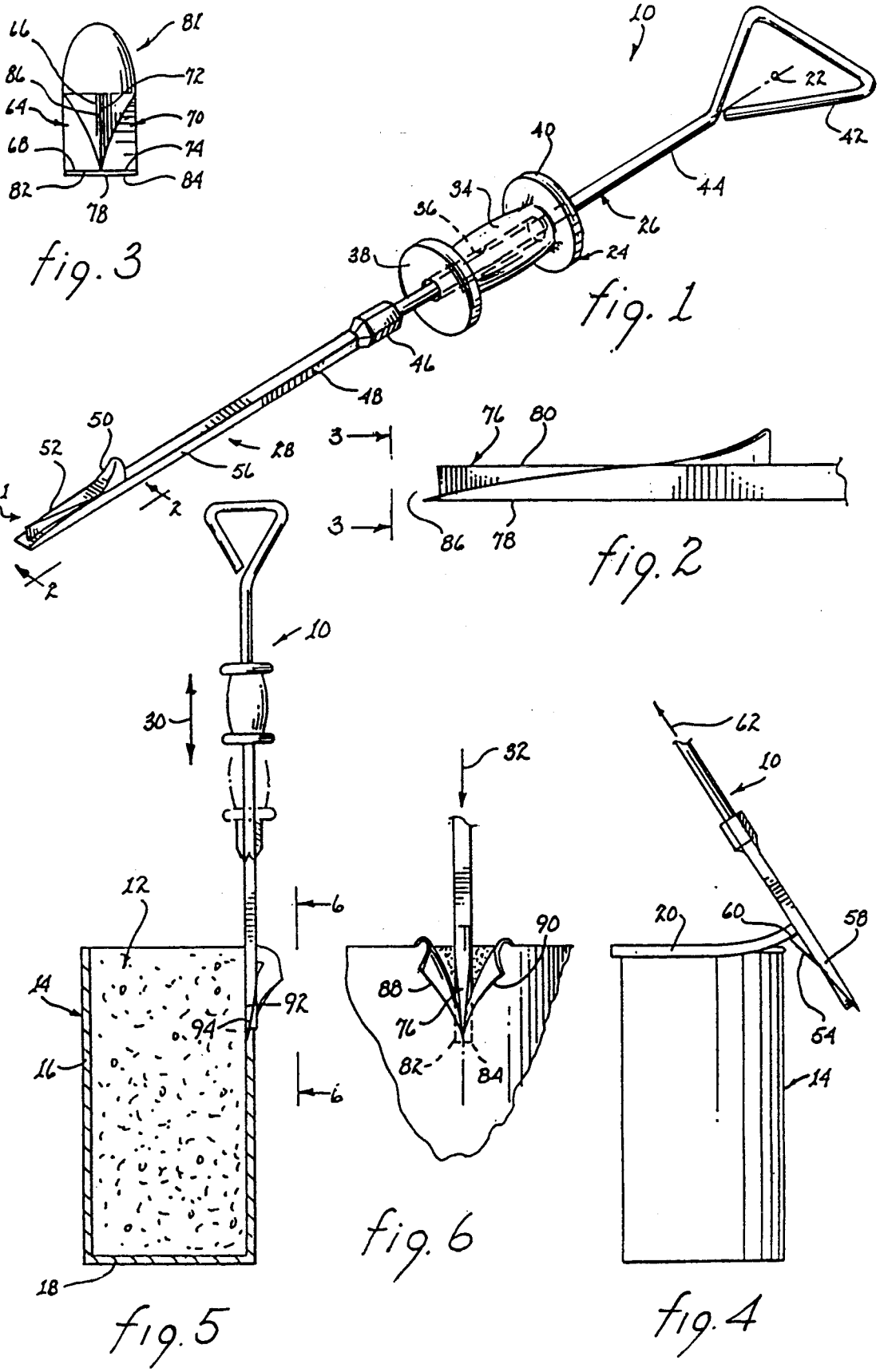
FIG. 1 is a perspective view of a mold extractor according to the invention.
FIG. 2 is a side elevational view as taken along line 2—2 of FIG. 1.
FIG. 3 is an elevational view as taken along line 3—3 of FIG. 2.
FIG. 4 is an elevation view of the mold extractor of FIG. 1 when used to remove a top cover or lid of a mold.
FIG. 5 is another elevation view of the mold extractor of FIG. 1 when used to cut away another portion of the mold of FIG. 4.
FIG. 6 is an elevational view as taken along line 6—6 of FIG. 5.

As shown in FIGS. 1, 4, 5 and 6, a mold extractor or tool 10 is used to separate a concrete test sample 12 (see FIG. 5) from its mold 14 (see FIG. 4). Concrete sample 12 is the type of sample which is poured at a construction site for later testing of, for example, tho compression failure stress by a laboratory. Container or mold 14 has an annular wall 16, a bottom wall 18 (see FIG. 5) and a removable top wall or lid 20 (see FIG. 4).

Extractor tool 10, which has an axis 22 (see FIG. 1), includes a hammer member 24, a guide member 26, and an elongate chisel member 28. Hammer 24 is moved in a reciprocal displacement direction 30 along axis 22 for applying a downward impact force 32 to chisel member 28 and then to container 14 (FIG. 6).

As shown in FIG. 1, hammer 24 has a peripheral wall 34, which has an axial hole 36 that receives guide member 26. Hammer 24 also has a bottom enlarged portion 38 and a top enlarged portion 40.

As shown in FIG. 1, guide member 26 has a handle portion 42 to be held by the operator and has an elongate bar portion 44 for guiding hammer 24. Bar 44 ,is preferably circular in cross sectional profile.

As shown in FIG. 1, chisel member 28 has an enlarged head portion 46, which receives impact force 32, and which is fixedly and coaxially connected to guide bar portion 44. Chisel member 28 has an elongate square bar portion 48 which is fixedly and coaxially connected to head portion 46. Chisel member 28 also has a claw portion 50, which is fixedly and coaxially connected to square bar portion 48, and has a chisel end portion 52, which is fixedly and coaxially connected to claw portion 50.

As shown in FIG. 4, claw portion 50 has an inclined face 54, first and second side surfaces 56, 58 and a claw or bearing surface 60. Surface 60 bears against the underside of container lid 20 for removing lid 20 from wall 16. Tool 10 applies an upward force 62 on lid 20 when removing lid 20.

As shown in FIGS. 1, 2 and 3, chisel end portion 52 has a left groove 64, which has vertical surface 66 and horizontal surface 68 (FIG. 3). Chisel end portion 52 has a right groove 70, which has a vertical surface 72 and horizontal surface 74. Chisel end portion 52 has a center wall 76, disposed between surfaces 66 and 72. Center wall 76 (FIG. 2) has a bottom surface 78 and top surface 80.

Chisel end portion 52 has a tip portion 82 (FIG. 3). Tip portion 81 has a first horizontal knife edge 82, disposed between surfaces 68, 78,.and has a second knife edge 84, disposed between surfaces 74, 78, and has a vertical knife edge 86, disposed between surfaces 66, 72.

In operation, vertical knife edge 86 cuts the container wall 16 forming cut edges 88, 90. As the impact force 32 is applied (FIG. 6), horizontal knife edges 82, 84 bear against concrete surfaces 92 and pass between concrete surface 92 and adjacent container inner surface 94 forming a separation or gap therebetween, just as the cutting action occurs.

While the invention has been described in the preferred embodiment, it is to be understood that the words which have been used are words of description rather than limitation and the changes may be made within the purview of the appended claim. without departing from the true scope and spirit of the invention in its broader aspects.

I claim:

1. A mold extractor comprising:

a chisel end portion;

chisel shaft member means connected to said chisel end portion for applying an impact force to said chisel end portion; said chisel end portion comprising a first straight knife edge means for separating a mold and a second straight knife edge means for cutting a mold, said first straight knife edge means and said second straight knife edge means forming a substantially T-shaped tip portion, said substantially T-shaped tip portion being located at an end said chisel end portion and having a width substantially equal to a width of said chisel shaft member means, said first straight knife edge means having a tapered portion with a narrow portion at an end of said substantially T-shaped tip portion for facilitating entry of said first straight knife edge means inside of said mold and for exposing said second knife edge means for cutting said mold, said tapered portion having a wider portion substantially equal to the width of said chisel shaft member means;

claw means for removing a container lid, said claw means being mounted on said chisel shaft member means in a direction to apply a force opposite in direction to a force exerted by said first and second knife edge means, said claw means having a first portion extending outwardly from a surface of said chisel shaft member means spaced from said second straight knife edge means, said claw means being located on the same side of said chisel shaft member means as said second straight knife edge means, said claw means having an inwardly sloped portion extending from said first portion to said second straight knife edge means and being a continuation of said tapered portion of said first straight knife edge means to facilitate cutting of said mold.

* * * * *